US007387090B2

(12) United States Patent
Russoniello et al.

(10) Patent No.: US 7,387,090 B2
(45) Date of Patent: Jun. 17, 2008

(54) METHOD FOR CONTROL OF STEAM QUALITY ON MULTIPATH STEAM GENERATOR

(76) Inventors: Fabio M. Russoniello, 4520 Stine Rd., Suite 7, Bakersfield, CA (US) 93313; Steven David Bopp, 4520 Stine Rd., Suite 7, Bakersfield, CA (US) 93313; Terry L. Kloth, 6801 Murphy's Ct., Bakersfield, CA (US) 93309

( * ) Notice: Subject to any disclaimer, the term of this patent is extended or adjusted under 35 U.S.C. 154(b) by 108 days.

(21) Appl. No.: 11/317,686

(22) Filed: Dec. 23, 2005

(65) Prior Publication Data

US 2007/0144457 A1 Jun. 28, 2007

(51) Int. Cl.
*F22D 7/12* (2006.01)

(52) U.S. Cl. ..... 122/406.1; 236/20 R

(58) Field of Classification Search ..... 122/406.1, 122/411, 448.3; 236/20 R, 24.5, 26 R
See application file for complete search history.

(56) References Cited

U.S. PATENT DOCUMENTS 2,780,206 A * 2/1957 La Rocque et al. ..... 122/448.3
3,057,164 A 10/1962 Opladen
3,169,373 A * 2/1965 Hanzalek ..... 60/648
3,413,808 A 12/1968 Knizia
3,423,933 A 1/1969 Knizia
4,489,679 A 12/1984 Holt
4,535,594 A 8/1985 Allam
4,887,431 A 12/1989 Peet
6,032,468 A 3/2000 Fetescu
6,536,380 B1 3/2003 Kral
6,619,041 B2 9/2003 Marin
2004/0200222 A1 10/2004 Marin
2006/0065213 A1 * 3/2006 Sarkar ..... 122/406.1

* cited by examiner

*Primary Examiner*—Gregory A Wilson
(74) *Attorney, Agent, or Firm*—Dennis W. Beech

(57) ABSTRACT

The present invention relates to systems and methods for control of a steam generating process having a steam generator with multiple water flow conduits disposed in a convection section and a radiant section. A first conduit may have a first diverted convection section water that may flow through a second preheater of a second conduit intermediate a first element of the convection section and a first radiant section. The second conduit may have a second diverted convection section water that may flow through a first section preheater intermediate a second element of the convection section and a second radiant section. A first temperature controlled valve may control the first diverted convection section water flow rate and a second temperature controlled valve may control the second diverted convection section water flow rate.

7 Claims, 1 Drawing Sheet

METHOD FOR CONTROL OF STEAM QUALITY ON MULTIPATH STEAM GENERATOR

BACKGROUND OF THE INVENTION

This invention relates to apparatus and systems for generating steam. The new system and method may allow for control of the steam generating process to output a desired steam quality from a multipath or multipass steam generator using crossover preheating of influent water flow in multiple fluid flow conduits or pipes.

Currently steam generators may be used to convert water to steam that may not be saturated. The water conversion may convert 70 percent to 80 percent of influent water to steam. The percent conversion achieved may be known as the steam quality. The unconverted or residual water may be effluent water from the steam generation process.

A single fluid flow conduit or multiple fluid flow conduits may be disposed in a heating container or vessel that may be heated by a combustible fuel, such as, a petroleum product, coal or the like. The fluid of water and steam may be heated in two steps in a steam generator convection section and in a radiant section. The steam generator may be structured for the influent water to be heated first in the convection section that may be downstream in the heated gas flow from the radiant section of the heating container. A heating gas may be at a lower temperature in the convection section relative to the radiant section. The convection section heated water may then be routed to the radiant section for heating to produce a steam effluent.

As water may be converted to steam the velocity of the fluid that may be a water and steam mixture may increase as a result of an increase in the volume of the fluid flowing in the conduit. This increase in velocity may result in an increased pressure drop in the conduit and increased conduit deterioration or wear. To reduce this effect multiple fluid flow conduit, such as, dual path or dual pass, steam generators may be used to generate steam. A dual conduit steam generator may have two approximately parallel or similar fluid flow conduits through which approximately the same total amount of water flows as may flow in a single fluid flow conduit steam generator. In a dual conduit steam generator the total water flow may be divided between the two conduits such that the fluid velocity in each conduit may be reduced which may reduce the wear on the conduits.

In a dual conduit steam generator the steam quality of the two conduit flows may be unequal as a result of differences in heat transfer rates or other factors. It may be necessary to control the water flow rate in each conduit to reduce conduit damage that may result from more water conversion to steam in one conduit relative to the other conduit. Controlling the water flow through each conduit as a function of steam quality may maintain the steam quality between each conduit as approximately equal. This method or process may result in each conduit flow producing approximately equal steam quality, but having unequal water flow.

In order to improve steam generator performance a portion of the heat energy in the water exiting the convection section may be used to heat the cooler influent water prior to its entering the convection section. Water exiting the convection section may be diverted prior to entering the radiant section and may be used to preheat the influent water. Existing steam generator systems may preheat the influent water to a temperature that may be a controlled fixed value.

SUMMARY OF THE INVENTION

The present invention is directed to systems and methods for control of a steam generating process having a steam generator with multiple water flow conduits disposed in a convection section and a radiant section. A first conduit may have a first diverted convection section water that may flow through a second preheater of a second conduit intermediate a first element of the convection section and a first radiant section. The second conduit may have a second diverted convection section water that may flow through a first section preheater intermediate a second element of the convection section and a second radiant section. A first temperature controlled valve may control the first diverted convection section water flow rate and a second temperature controlled valve may control the second diverted convection water flow rate.

These and other features, aspects and advantages of the present invention will become better understood with reference to the following drawings, description and claims.

DETAILED DESCRIPTION

Figure 1:
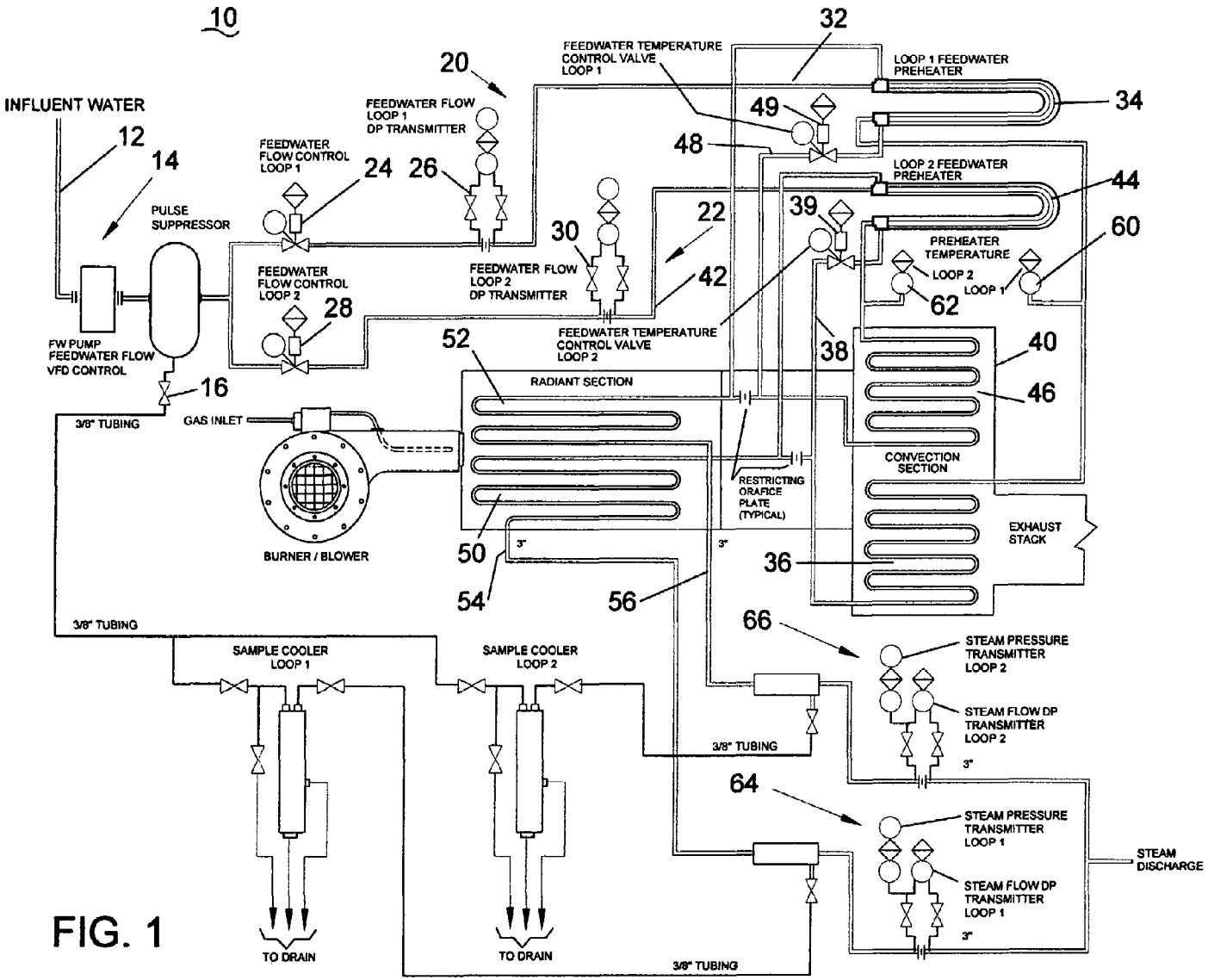
FIG. 1 illustrates a schematic view of elements of a dual path steam generator according to an embodiment of the invention.

The following detailed description represents the best currently contemplated modes for carrying out the invention. The description is not to be taken in a limiting sense, but is made merely for the purpose of illustrating the general principles of the invention.

Referring to FIG. 1, a steam generation 10 may be represented in schematic form as a dual fluid flow conduit or pass steam generator 10. The steam generator 10 may have an influent water flow 12 that may be conditioned 14 and a portion diverted as controlled by diverter valve 16 or a variable pressure regulated pump may be used for control of the speed of the pump. The influent water may then be split to flow in a first conduit 20 and a second conduit 22. The volume of influent water flow 12 in each conduit 20, 22 may be controlled by a first flow valve 24 and first flow transmitter 26 and a second flow valve 28 and second flow transmitter 30.

A first water portion 32 may flow through a first preheater 34 and then through a first element 36 of a convection section 40. A portion of the first water portion 32 may be diverted as may be controlled by a first temperature controlled valve 39 to flow through a second preheater 44 to preheat a second water portion 42 in the second conduit 22. The preheater 34, 44 may be a double walled pipe having the water portions 32, 42 flowing in an inner pipe and the diverted convection section water portions 38, 48 flowing in an outer pipe. The first diverted convection section water 38 may exit the second preheater 44 and merge with the first water portion 32 to inflow into the first radiant section 50. A first steam flow channel 54 may exit the first radiant section 50 to merge with a second steam flow channel 56 to be discharged from the steam generator 10.

In a like process the second water portion 42 may flow through the second preheater 44 and a second element 46 of the convection section 40. A portion may be diverted as second diverted convection section water 48 to flow through the first preheater 34 and exit therefrom to merge with the second water portion 42 to inflow into a second radiant section 52. A second steam flow channel 56 may exit the second radiant section 52 to merge with the first steam flow channel 54 to be discharged from the steam generator 10.

There may be temperature sensors 60, 62 to monitor water portions 32, 42 temperature intermediate the preheaters 34, 44 and the convection section 40. There may also be steam pressure measurement elements 64, 66 prior to the merging of the steam flows 54, 56 for measuring steam quality.

The water portions 32, 42 flow rate may be controlled to be approximately equal and the steam quality between the first steam flow 54 and the second steam flow 56 may be controlled to be approximately equal by controlling the outlet temperature of each preheater 34, 44.

The steam quality control may be implemented by a control system (not shown) by controlling the amount of diverted convection section water 38, 48 flows through each preheater 34, 44 using temperature controlled valves 39, 49. This process may compensate for differences in the heat transfer characteristics of the two conduits 20, 22 by transfer of a portion of heat energy from the water portion 32, 42 having the higher heat transfer to that having the lower heat transfer. The result may be that each steam flow 54, 56 may have approximately the same steam quality and fluid flow rate.

While the invention has been particularly shown and described with respect to the illustrated embodiments thereof, it will be understood by those skilled in the art that the foregoing and other changes in form and details may be made therein without departing from the spirit and scope of the invention.

I claim:

1. A system for control of a steam generating process having a steam generator with a plurality of water flow conduits disposed in a convection section and a radiant section comprising:

a first conduit having a first diverted convection section water flow through a second preheater of a second conduit intermediate a first element of said convection section and a first radiant section;

a second conduit having a second diverted convection section water flow through a first preheater intermediate a second element of said convection section and a second radiant section; and a first temperature controlled valve controlling a flow rate of said first diverted convection section water flow and a second temperature controlled valve controlling a flow rate of said second diverted convection section water flow.

2. The system as in claim 1 wherein said first preheater and said second preheater are a dual pipe preheater.

3. The system as in claim 1 wherein said first diverted convection section water exits said second preheater and merges with a first water portion to inflow into said first radiant section; and said second diverted convection section water exits said first preheater and merges with a second water portion to inflow into said second radiant section.

4. The system as in claim 1 wherein a flow rate of a first water portion and a flow rate of a second water portion are controlled to be approximately equal; and a steam quality of a first steam output flow channel and a steam quality of a second steam output flow channel are controlled to be approximately equal by control of each outlet temperature of each preheater of each conduit.

5. A method for control of a steam generating process having a steam generator with a plurality of water flow conduits disposed in a convection section and a radiant section comprising:

diverting a portion of a first conduit water flow exiting said convection section as a first diverted convection section water to flow through a second preheater of a second conduit water flow intermediate said convection section and said radiant section;

diverting a portion of said second conduit water flow exciting said convection section as a second diverted convection section water to flow through a first preheater of said first conduit water flow intermediate said convection section and said radiant section; and controlling a flow rate of said first diverted convection section water with a first temperature controlled valve and a flow rate of said second diverted convection section water with a second temperature controlled valve.

6. The method as in claim 5 further comprising:

merging said first diverted convection section water exiting said second preheater with said first conduit water exiting said first preheater prior to inflow into said radiant section; and merging said second diverted convection section water exiting said first preheater with said second conduit water exiting said second preheater prior to inflow into said radiant section.

7. The method as in claim 5 further comprising:

measuring a temperature of said first conduit water flow exiting said first preheater and a temperature of said second conduit water flow exiting said second preheater for use in control of said first temperature controlled valve and said second temperature controlled valve.

* * * * *